US008487812B1

(12) United States Patent
Stratton

(10) Patent No.: US 8,487,812 B1
(45) Date of Patent: Jul. 16, 2013

(54) METHOD FOR SELF-ALIGNING A BEAMFORMING SENSOR TO SIMPLIFY VEHICLE INSTALLATION

(75) Inventor: Donald A. Stratton, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 225 days.

(21) Appl. No.: 13/151,674

(22) Filed: Jun. 2, 2011

(51) Int. Cl.
*H01Q 3/00* (2006.01)

(52) U.S. Cl.
USPC ..... 342/359

(58) Field of Classification Search
USPC ..... 342/359
See application file for complete search history.

(56) References Cited

U.S. PATENT DOCUMENTS

2012/0281781 A1* 11/2012 Xiao et al. ..... 375/267

* cited by examiner

*Primary Examiner* — Harry Liu
(74) *Attorney, Agent, or Firm* — Donna P. Suchy; Daniel M. Barbieri

(57) ABSTRACT

The present invention is a method for aligning a beamforming system relative to a platform, said beamforming system being positioned on-board the platform. The method described in the present disclosure extends beyond currently available techniques by providing an adaptive beamsteering function which is available during installation of the beamforming system. This adaptive beamsteering function may determine the orientation error of the beamforming system by adaptively searching for correlated behavior of multiple satellite signals, seeking an orientation where a Correlated Power Function (CPF) is maximized. This orientation, relative to the input aiding system (ex. —INS) may provide a set of correction factors which enable the sensor (ex. —beamforming system) to utilize the input aiding system in an arbitrary orientation (ex. —as long as that arbitrary orientation is suitable for GPS reception).

20 Claims, 2 Drawing Sheets

METHOD FOR SELF-ALIGNING A BEAMFORMING SENSOR TO SIMPLIFY VEHICLE INSTALLATION

FIELD OF THE INVENTION

The present invention relates to the field of navigation systems and particularly to a method for self-aligning a beamforming sensor to simplify vehicle installation.

BACKGROUND OF THE INVENTION

Currently, during installation of a beamforming sensor on-board a vehicle, installers have had difficulty in aligning the axes of the beamforming sensor with the vehicle body axes. Improper alignment of the axes of the beamforming sensor relative to the vehicle body axes has been known to cause a degradation of performance for the beamforming sensor. Further, currently-implemented alignment methods have proven to be labor-intensive and time-consuming. Thus, it would be desirable to provide a method which obviates the above-referenced problems associated with the above-referenced current solutions.

SUMMARY OF THE INVENTION

Accordingly, an embodiment of the present invention is directed to a method for aligning a beamforming system (ex. —beamforming sensor) relative to a platform (exs. —a mobile platform, a vehicle, a precision-guided projectile, etc.), said beamforming system being positioned on-board the platform, said method including: receiving an input for placing the beamforming system in an auto-alignment mode; acquiring a set of satellite navigation system signals (ex. —GPS signals) tracking the set of satellite navigation signals (ex. —GPS signals) via a plurality of antenna elements of an antenna system of the beamforming system, said set of satellite navigation signals being tracked by the beamforming system subsequent to the acquisition of the satellite navigation signals; adaptively processing the tracked satellite navigation signals via a processor of the system, said processing including: coherently combining the signals from the antenna system; determining relative carrier-to-noise density ratios for various combinations of the tracked satellite navigation signals; and determining a plurality of orientations of interest in body axes values of the platform based upon said determining of the relative carrier-to-noise density ratios; receiving aiding inputs (ex. —six Degrees-Of-Freedom aiding inputs) at the beamforming system from an input aiding system (ex. —an Inertial Navigation System); and inverting the vehicle body axes values to inertial axes values via utilization of the received aiding inputs.

A further embodiment of the present invention is directed to a non-transitory, computer-readable medium having computer-executable instructions for performing a method for aligning a beamforming system (ex. —beamforming sensor) relative to a platform (exs. —a mobile platform, a vehicle, a precision-guided projectile, etc.), said beamforming system being positioned on-board the platform, said method including: receiving an input for placing the beamforming system in an auto-alignment mode; acquiring a first set of satellite navigation system signals (ex. —GPS signals) tracking the set of satellite navigation signals (ex. —GPS signals) via a plurality of antenna elements of an antenna system of the beamforming system, said set of satellite navigation signals being tracked by the beamforming system subsequent to the acquisition of satellite navigation signals; adaptively processing the tracked satellite navigation signals via a processor of the system, said processing including: coherently combining the tracked signals; determining relative carrier-to-noise density ratios for various combinations of the tracked satellite navigation signals; and determining a plurality of directions of interest in body axes values of the platform based upon said determining of the relative carrier-to-noise density ratios; receiving aiding inputs (ex. —six Degrees-Of-Freedom aiding inputs) at the beamforming system from an input aiding system (ex. —an Inertial Navigation System); and inverting the vehicle body axes values to inertial axes values via utilization of the received aiding inputs.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present disclosure may be better understood by those skilled in the art by reference to the accompanying figures in which.

DETAILED DESCRIPTION OF THE INVENTION

Figure 1:
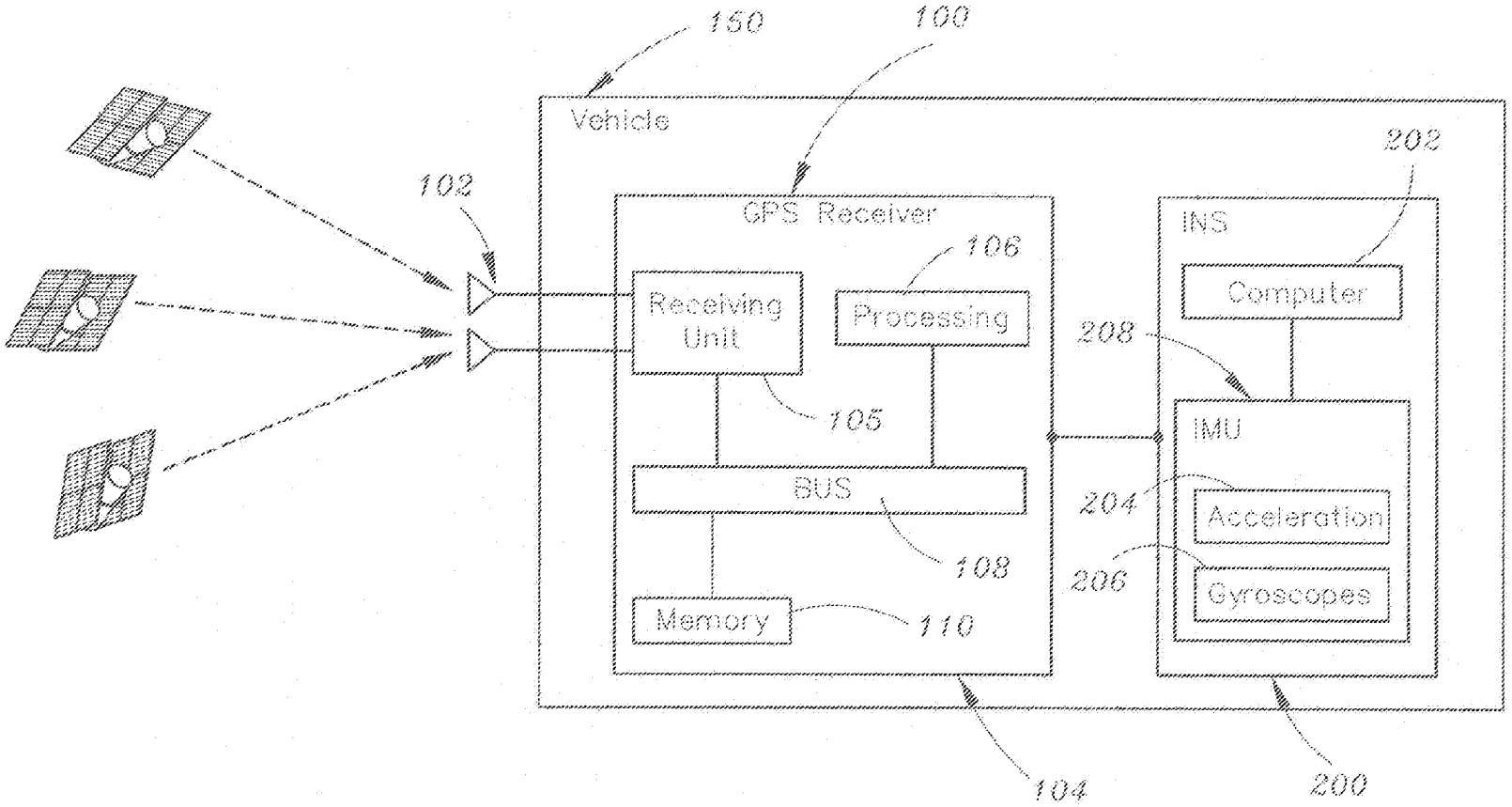
FIG. 1 is a block diagram schematic of a beamforming system (ex. —beamforming sensor) in accordance with an exemplary embodiment of the present disclosure, said beamforming system being on-board a platform and being communicatively coupled with an Inertial Navigation System.

Reference will now be made in detail to the presently preferred embodiments of the invention, examples of which are illustrated in the accompanying drawings.

Currently, during installation of a beamforming sensor (ex. —beamforming system) on-board a vehicle, installers have had difficulty in aligning the axes of the beamforming sensor with the vehicle body axes. For instance, during installation of Ship Global Positioning System (GPS) Sensor Units (SGSUs) on-board a ship (ex. —on-board the aircraft carrier, CVN-76), the on-site team had great difficulty aligning the axes of the Controlled Reception Pattern Antenna (CRPA)/Digital Beamforming (DBF) sensor with the ship body axes. Alignment of the axes of the CRPA/DBF sensor with the ship body axes is required to tight constraints in order to provide accurate GPS observables for shipboard landing.

CRPA/DBF sensors have unique installation requirements relative to legacy GPS Antenna System-1 (GAS-1) nulling systems because of the need to maintain constraints in the direction of satellite signals under vehicle dynamics. Current installation procedures for installing an SGSU on-board a ship require precision alignment of both the mounting posts of the SGSU and the mount of the SGSU.

As mentioned above, current beamforming system installation procedures include angular alignment survey. Angular alignment survey is necessary in order to ensure that beams steer correctly in inertial space as the vehicle moves. A DBF sensor may receive six Degree-Of-Freedom (6 DOF) aiding inputs from an input aiding system (ex. —an Inertial Navigation System (INS)). When the axes of the DBF sensor are properly aligned with the vehicle body axes, the DBF sensor transforms these inputs to vehicle body axes to determine a pointing vector(s). Improper alignment of the axes of the DBF sensor relative to the vehicle body axes may degrade code- and carrier-phase measurement quality (critical for Joint Precision Approach and Landing Systems (JPALS)), as well as degrading anti-jam performance. Further, legacy analog nulling systems (ex. —GAS-1 nulling systems) do not require angular alignment, as they steer nulls directly in the vehicle body axes.

In further instances, angular alignment of other beamforming sensors (ex. —JPALS sensors) installed on-board a ship has proven to be difficult. For example, installing a complement of JPALS ship sensors on-board a ship generally involves a multi-day procedure. Installing beamforming sensors on-board other vehicles, such as aircraft, may present similar difficulties. The present disclosure provides a method (ex. —an automated procedure) via which a beamforming sensor may self-align when installed on-board a vehicle, thereby simplifying the installation process by making the installation process less labor-intensive.

Self-survey and self-calibration techniques for beamsteering signals currently exist. However, the method described in the present disclosure extends beyond these currently available techniques by providing an adaptive beamsteering function which is available during installation of the beamforming system (ex. —unit). This adaptive beamsteering function may determine the orientation error of the beamforming system by adaptively searching for correlated behavior of multiple satellite signals, seeking an orientation where a Correlated Power Function (CPF) is maximized. This orientation, relative to the input aiding system (ex. —INS) may provide a set of correction factors which enable the sensor (ex. —beamforming system) to utilize the input aiding system in an arbitrary orientation (ex. —as long as that arbitrary orientation is suitable for GPS reception). The method of the present disclosure may be applicable to beamforming system installation on-board various types of vehicles (exs. —ships, aircraft, etc.). The method of the present disclosure may be applicable to federated installations (ex. —separate antenna electronics (AE) with GPS Embedded Module/Airborne Selective Availability Anti-Spoofing Module Receiver (GEM/ASR) installed in Embedded GPS in INS (EGI)), as well as integrated (Digital Integrated Anti-Jam Receiver (DIGAR)) architectures. The method of the present disclosure may also be implemented in anti-jam GPS sensor systems. The method of the present disclosure may also be combined with existing auto-calibration methods to provide a completely self-surveying, self-calibrating DBF. The method of the present disclosure may also be applicable to land-based JPALS. The method(s) of the present disclosure and a system(s) for implementing same will be described in detail below.

Referring to FIG. 1, a system in accordance with an embodiment of the present disclosure is shown. In an embodiment of the present disclosure, the system 100 (exs. —a beamforming system; a beamforming sensor) is implemented on-board a platform 150 (exs. —a mobile platform 150; a vehicle 150), such as a watercraft, an aircraft, a land-based vehicle, a spacecraft, a precision-guided munition, a projectile, and/or the like. In an exemplary embodiment of the present disclosure, the system 100 may be a navigation (Nav) system, such as a Global Navigation Satellite Systems (GNSS) system (ex. —a GPS system). In further embodiments, the system (ex. —sensor) 100 may be a GPS Sensor Unit (GSU), a Ship GPS Sensor Unit (SGSU), a SGSU sensor system, a GPS sensor, a GPS sensor system, a DBF sensor, a CRPA system, a DBF system, a beamsteering sensor, a beamsteering system, a JPALS system, a JPALS sensor, a JPALS sensor system, and/or a JPALS ship sensor. In a further embodiment of the present disclosure, the system 100 may be an integrated navigation and communication system (ex. —a Nav/Comm system).

In exemplary embodiments of the present disclosure, the system 100 includes an antenna system 102 (ex. —antenna array, sensor array). The antenna system 102 includes one or more antenna(s) (ex. —antenna elements), the antennas being established (ex. —spaced apart) in a known spatial orientation with respect to each other. In an embodiment of the present disclosure, the antenna system 102 may be a navigation antenna system, such as a GNSS antenna system (ex. —GPS antenna system; a GPS antenna array). For instance, in embodiments in which the antenna system 102 is a navigation antenna system, the antennas of the navigation antenna system are configured for receiving signals, such as Radio Frequency signals, satellite signals (ex. —satellite navigation signals, satellite positioning signals). In a further embodiment of the present disclosure, the antenna system 102 may be an integrated navigation and communication antenna system (ex. —Nav/Comm antenna array). For instance, in embodiments in which the antenna system 102 is a Nav/Comm antenna system, antennas of the integrated navigation and communication antenna system are configured for both transmitting and receiving signals. In still further embodiments of the present disclosure, the antennas of the antenna system 102 are configured for being connected to (ex. —are configured for being positioned, located and/or installed on-board) the vehicle 150.

In an embodiment of the present disclosure, the system 100 includes a receiver 104. For instance, the receiver 104 may be implemented on-board the vehicle 150. The receiver 104 is connected to the antenna system 102 and is configured for receiving Radio Frequency (RF) inputs from the antenna system 102, the RF inputs including the received signals. For example, if the antenna system 102 is a Nav antenna system (ex. —a GPS antenna system), the receiver 104 may be a GPS receiver configured for receiving RF inputs provided by GPS antennas. Further, if the antenna system 102 is a Nav/Comm antenna system, its corresponding receiver 104 may be a transceiver (ex. —a Nav/Comm receiver) configured for receiving RF inputs from and providing RF outputs to Nav/Comm antennas. The receiver 104 of the system 100 may be configured for determining (ex. —dynamically determining) a location (ex. —an in-flight location) of the receiver 104 based on the received RF inputs from the antenna system 102. In an embodiment of the present invention, the receiver 104 includes a receiving unit 105, said receiving unit 105 configured for receiving the RF inputs provided by the antenna system 102. In further embodiments, the beamforming system 100 may be further configured for receiving aiding inputs provided by an input aiding system 200 (ex. —an INS), said INS 200 being communicatively coupled with the beamforming system, said INS 200 also being connected to the vehicle 150 (ex. —installed, located, and/or positioned on-board the vehicle 150).

In exemplary embodiments of the present disclosure, the system 100 includes a processor 106. For instance, the processor 106 may be implemented on-board the vehicle 150 and may be implemented as part of the receiver 104. The processor 106 may be connected to the receiving unit 105 via an interface (ex. —bus) 108, said processor 106 and receiving unit 105 each being connected to the bus 108. The receiving unit 105 is configured for providing the received RF inputs to the processor 106. The processor 106 is configured for processing said RF inputs for determining (ex. —dynamically determining) a location (ex. —an in-flight location) of the receiver 104 based on the received RF inputs from the antenna array 102. The processor 106 may be further configured for obtaining a location of the vehicle 150 from the aiding inputs provided to the beamforming system 100 by the INS 200.

In an embodiment of the present disclosure, the system 100 includes a memory 110, said memory 110 being connected to the processor 106. Further, said memory 110 may be implemented as part of the receiver 104. For example, the memory 110 may be connected to the processor 106 via the bus 108.

As mentioned above, in exemplary embodiments of the present disclosure, the system 100 may be communicatively coupled with an Inertial Navigation System (INS) 200. The INS 200 may include a computer 202, a plurality of motion sensors (ex. —accelerometers) 204, and a plurality of rotation sensors (ex. —gyroscopes) 206. The plurality of motion sensors 204 and the plurality of rotation sensors 206 may collectively be included as part of and/or contained within a module (ex. —an Inertial Measurement Unit (IMU)) 208. As mentioned above, the INS 200 may be implemented (ex. —located, positioned and/or installed) on-board the vehicle 150. The INS 200 is configured for dynamically obtaining information via its motion sensors 204 and rotation sensors 206. The motion sensors 204 and rotation sensors 206 are then configured for dynamically providing the obtained information to the computer 202. The computer 202 is configured for dynamically calculating a position and velocity of the vehicle 150 based upon the information provided by the motion sensors 204 and/or rotation sensors 206. For instance, the INS 200 may be configured for dynamically (ex. —continuously) determining a position, orientation, velocity (ex. —direction/speed of movement) and/or attitude of the vehicle 150 (ex. —via dead reckoning) without needing external references. However, the INS 200 may need to be initialized with an initial position and an initial velocity of the vehicle 150 (or INS 200) which may be provided via the GPS receiver 104 or a human operator.

In an embodiment of the present disclosure, the INS 200 may be configured for providing the dynamically-determined position, orientation, velocity and/or attitude of the vehicle 150 to the beamforming system 100. For instance, the information provided to the beamforming system 100 from the INS 200 may include aiding inputs, such as six Degree(s)-Of-Freedom (6 DOF) aiding inputs.

As mentioned above, when installing the beamforming system (ex —beamforming sensor) 100 on-board a vehicle 150, it is important to align axes of the beamforming system 100 with axes of the body of the vehicle 150 to ensure accurate performance of the beamforming system 100 (ex. —to ensure accurate acquisition and tracking of GPS signals). In order for accurate alignment of the axes of the beamforming system 100 with the axes of the body of the vehicle 150 to occur, it is important to know not only the location (ex. —orientation) of the vehicle 150 (which may be provided by the INS 200), but also the orientation of the beamforming system 100 relative to the vehicle 150. Currently implemented alignment methods are labor-intensive and may result in an installation process which takes days to complete. The self-alignment method (ex. —beamforming system-performed, automated self-alignment method) disclosed herein may simplify the process of installation of the beamforming system 100 on-board a vehicle 150.

Figure 2:
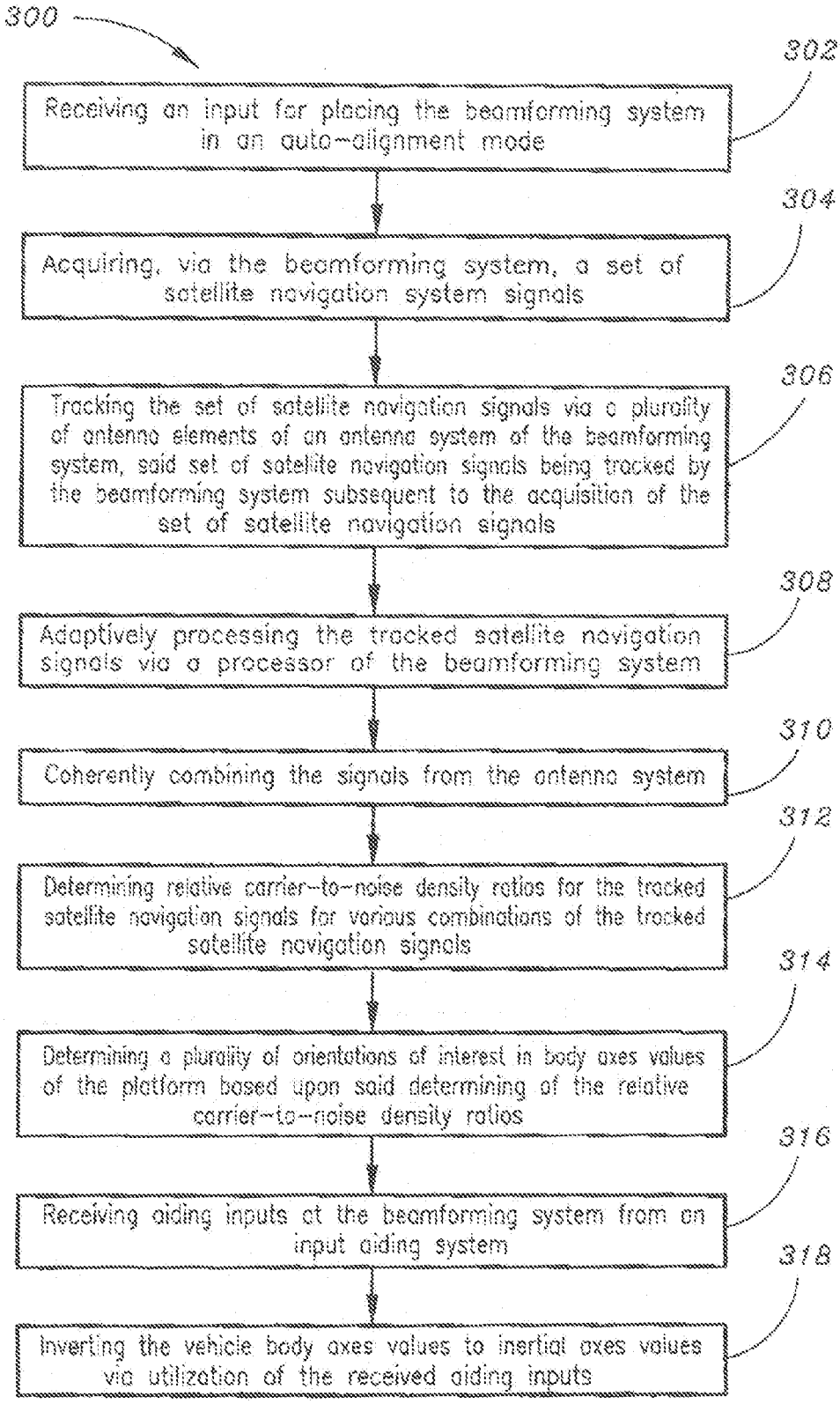
FIG. 2 is a method for aligning a beamforming system (ex. —such as the beamforming system shown in FIG. 1) in accordance with an exemplary embodiment of the present disclosure.

Referring to FIG. 2, a flow chart is shown which illustrates a method for aligning a beamforming system (ex. —such as beamforming system 100 shown in FIG. 1) in accordance with an exemplary embodiment of the present disclosure. The method 300 includes the step of receiving an input for placing the beamforming system in an auto-alignment mode 302. For example, when the beamforming system has been installed (ex. —by a user) in a desired location on-board the platform (ex. —vehicle) 150, the user may provide an input (ex. —an initializing input) to the beamforming system 100 (ex. —via a user input device connected to the beamforming system 100) for causing an auto-alignment mode of the beamforming system to be activated.

In further embodiments of the present disclosure, the method 300 further includes the step of acquiring (ex. —receiving), in a pass-through mode, a set of satellite navigation system signals 304. For instance, when the beamforming system 100 is in auto-alignment mode, it is configured for performing a basic acquisition in a pass-through mode (ex. —using only a reference antenna or reference antenna element of the antenna system 102) in which the beamforming system 100 acquires a set of satellite navigation system signals, such as a set of GPS signals.

In exemplary embodiments of the present disclosure, the method 300 further includes tracking the set of satellite navigation signals via a plurality of antenna elements of the antenna system, said set of satellite navigation signals being tracked by the beamforming system subsequent to the acquisition of the satellite navigation signals 306. For instance, following acquisition of the satellite navigation signals (ex. —GPS signals), the beamforming system 100 is configured for steering a set of beams (ex. —14-16 beams) in random directions (ex. —receiving satellite navigation signals via a random reception pattern).

In further embodiments of the present disclosure, the method 300 further includes the step of processing the tracked satellite navigation signals via the processor of the system 308. In exemplary embodiments, adaptively processing said received satellite navigation signals may include sub-steps of: coherently combining the tracked signals from the antenna system 310, determining relative carrier-to-noise density ratios for various combinations of the tracked satellite navigation signals 312, and determining a plurality of orientations of interest in vehicle body axes values based upon said determining of the relative carrier-to-noise density ratios 314. For example, the beamforming system 100 determines orientations (in body axes values of the vehicle 150) of maximum carrier-to-noise density ratio.

In exemplary embodiments of the present disclosure, the method 300 further includes the step of receiving aiding inputs at the beamforming system from an input aiding system 316. For example, the input aiding system may be an INS 200, and the aiding inputs provided from the INS 200 to the beamforming system 100 may be six Degree-Of-Freedom (6 DOF) aiding inputs which provide the information about the orientation of the vehicle 150.

In further embodiments of the present disclosure, the method 300 further includes the step of inverting the vehicle body axes values to inertial axes values via utilization of the received aiding inputs 318.

The system(s)/method(s) of the present disclosure may utilize pointing vectors for a plurality of satellites (ex. —8-12 satellites) as inputs in an over-determined system of equations which may be solved for three unknowns (ex. —Euler angles) to determine the alignment of the beamforming system 100 (ex. —alignment of the antenna system 102 of the beamforming system 100) relative to the vehicle. The system (s)/method(s) of the present disclosure may utilize averaging estimates over a period of time to provide accurate alignment, with better quality alignment being obtained when utilizing averaging estimates obtained over longer periods of time.

It is to be noted that the foregoing described embodiments according to the present invention may be conveniently implemented using conventional general purpose digital computers programmed according to the teachings of the present specification, as will be apparent to those skilled in the computer art. Appropriate software coding may readily be prepared by skilled programmers based on the teachings of the present disclosure, as will be apparent to those skilled in the software art.

It is to be understood that the present invention may be conveniently implemented in forms of a software package. Such a software package may be a computer program product which employs a non-transitory computer-readable storage medium including stored computer code which is used to program a computer to perform the disclosed function and process of the present invention.

The computer-readable medium may include, but is not limited to, any type of conventional floppy disk, optical disk, CD-ROM, magnetic disk, hard disk drive, magneto-optical disk, ROM, RAM, EPROM, EEPROM, magnetic or optical card, or any other suitable media for storing electronic instructions.

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A method for aligning a beamforming system relative to a platform, said beamforming system being positioned on-board the platform, said method comprising:

receiving an input for placing the beamforming system in an auto-alignment mode;

acquiring, via the beamforming system, a set of satellite navigation system signals;

tracking the set of satellite navigation signals via a plurality of antenna elements of an antenna system of the beamforming system, said set of satellite navigation signals being tracked by the beamforming system subsequent to the acquisition of the set of satellite navigation signals; and adaptively processing the tracked satellite navigation signals via a processor of the beamforming system, said processing including: coherently combining the signals from the antenna system; determining relative carrier-to-noise density ratios for the tracked satellite navigation signals for various combinations of the tracked satellite navigation signals; and determining a plurality of orientations of interest in body axes values of the platform based upon said determining of the relative carrier-to-noise density ratios.

2. A method as claimed in claim 1, said method further comprising:

receiving aiding inputs at the beamforming system from an input aiding system.

3. A method as claimed in claim 2, said method further comprising:

inverting the vehicle body axes values to inertial axes values via utilization of the received aiding inputs.

4. A method as claimed in claim 1, wherein the received satellite navigation signals are Global Positioning System signals.

5. A method as claimed in claim 2, wherein the input aiding system is an Inertial Navigation System.

6. A method as claimed in claim 2, wherein the received aiding inputs are six Degrees-Of-Freedom aiding inputs.

7. A method as claimed in claim 1, wherein the platform is one of: a vehicle or a precision-guided projectile.

8. A method as claimed in claim 7, wherein the vehicle is one of: a watercraft, aircraft, land-based vehicle, or spacecraft.

9. A non-transitory, computer-readable medium having computer-executable instructions for performing a method for aligning a beamforming system relative to a platform, said beamforming system being positioned on-board the platform, said method comprising:

receiving an input for placing the beamforming system in an auto-alignment mode;

acquiring, via the beamforming system, a set of satellite navigation system signals;

tracking the set of satellite navigation signals via a plurality of antenna elements of an antenna system of the beamforming system, said set of satellite navigation signals being tracked by the beamforming system subsequent to the acquisition of the set of satellite navigation signals; and adaptively processing the tracked satellite navigation signals via a processor of the beamforming system, said processing including: coherently combining the signals from the antenna system; determining relative carrier-to-noise density ratios for the tracked satellite navigation signals for various combinations of the tracked satellite navigation signals; and determining a plurality of orientations of interest in body axes values of the platform based upon said determining of the relative carrier-to-noise density ratios.

10. A non-transitory, computer-readable medium having computer-executable instructions for performing a method as claimed in claim 9, said method further comprising:

receiving aiding inputs at the beamforming system from an input aiding system.

11. A non-transitory, computer-readable medium having computer-executable instructions for performing a method as claimed in claim 10, said method further comprising:

inverting the vehicle body axes values to inertial axes values via utilization of the received aiding inputs.

12. A non-transitory, computer-readable medium having computer-executable instructions for performing a method as claimed in claim 9, wherein the received satellite navigation signals are Global Positioning System signals.

13. A non-transitory, computer-readable medium having computer-executable instructions for performing a method as claimed in claim 10, wherein the input aiding system is an Inertial Navigation System.

14. A non-transitory, computer-readable medium having computer-executable instructions for performing a method as claimed in claim 10, wherein the received aiding inputs are six Degrees-Of-Freedom aiding inputs.

15. A non-transitory, computer-readable medium having computer-executable instructions for performing a method as claimed in claim 9, wherein the platform is one of: a vehicle or a precision-guided projectile.

16. A non-transitory, computer-readable medium having computer-executable instructions for performing a method as claimed in claim 15, wherein the vehicle is one of: a watercraft, aircraft, land-based vehicle, or spacecraft.

17. A beamforming system for implementation on-board a mobile platform, the beamforming system comprising:

means for receiving a user input for placing the beamforming system in an auto-alignment mode;

means for acquiring a set of satellite navigation system signals;

means for tracking the set of satellite navigation signals said set of satellite navigation signals being tracked by the beamforming system subsequent to the acquisition of the satellite navigation signals; and means for adaptively processing the tracked satellite navigation signals, said processing including: coherently combining the tracked signals; determining relative carrier-to-noise density ratios for various coherent combinations of the tracked signals; and determining a plurality of orientations of interest in body axes values of the platform based upon said determining of the relative carrier-to-noise density ratios.

18. A beamforming system as claimed in claim 17, further comprising:

means for receiving aiding inputs at the beamforming system from an input aiding system.

19. A beamforming system as claimed in claim 17, further comprising:

means for inverting the vehicle body axes values to inertial axes values via utilization of the received aiding inputs.

20. A beamforming system as claimed in claim 18, wherein the input aiding system is an Inertial Navigation System.

* * * * *